US010957981B2

(12) United States Patent
Yoshitake et al.

(10) Patent No.: US 10,957,981 B2
(45) Date of Patent: Mar. 23, 2021

(54) ANTENNA DEVICE

(71) Applicant: DENSO TEN Limited, Kobe (JP)

(72) Inventors: Hiroaki Yoshitake, Kobe (JP); Junzoh Tsuchiya, Kobe (JP); Norihisa Nishimoto, Kobe (JP)

(73) Assignee: DENSO TEN Limited, Kobe (JP)

( * ) Notice: Subject to any disclaimer, the term of this patent is extended or adjusted under 35 U.S.C. 154(b) by 31 days.

(21) Appl. No.: 16/354,682

(22) Filed: Mar. 15, 2019

(65) Prior Publication Data

US 2020/0058997 A1 Feb. 20, 2020

(30) Foreign Application Priority Data

Aug. 16, 2018 (JP) ..... JP2018-153139

(51) Int. Cl.
*H01Q 9/04* (2006.01)
*H01Q 21/06* (2006.01)

(52) U.S. Cl.
CPC ..... *H01Q 9/0407* (2013.01); *H01Q 21/061* (2013.01)

(58) Field of Classification Search
CPC ..... H01Q 9/04; H01Q 9/0407; H01Q 21/06; H01Q 21/061; H01Q 21/065; H01Q 21/08; H01Q 1/2283; H01Q 1/38; H01Q 19/005
See application file for complete search history.

(56) References Cited

U.S. PATENT DOCUMENTS 4,291,312 A * 9/1981 Kaloi ..... H01Q 1/48 343/700 MS
5,400,039 A * 3/1995 Araki ..... H01Q 1/32 343/700 MS
5,400,040 A * 3/1995 Lane ..... H01Q 1/286 343/700 MS
5,594,455 A * 1/1997 Hori ..... H01Q 9/0414 343/700 MS
6,133,879 A * 10/2000 Grangeat ..... H01Q 1/24 343/700 MS
6,133,880 A * 10/2000 Grangeat ..... H01P 5/08 343/700 MS
6,211,825 B1 * 4/2001 Deng ..... H01Q 1/38 343/700 MS
6,320,542 B1 * 11/2001 Yamamoto ..... H01Q 1/38 343/700 MS
6,323,810 B1 * 11/2001 Poilasne ..... H01Q 1/38 343/700 MS
10,476,149 B1 * 11/2019 Ueda ..... H01Q 1/24
2004/0027291 A1 * 2/2004 Zhang ..... H01Q 19/10 343/700 MS (Continued)

FOREIGN PATENT DOCUMENTS

JP 2005-333556 A 12/2005
JP 2006-173963 A 6/2006

*Primary Examiner* — Jason Crawford
(74) *Attorney, Agent, or Firm* — Oliff PLC

(57) ABSTRACT

An antenna device for transmitting and receiving radio waves by an antenna element formed as a conductive pattern on a substrate, and the antenna element includes: a first element part which is electrically connected to a power supply line; and two second element parts which are electrically connected to the first element part via connection lines, the connection lines being different from the power supply line.

8 Claims, 9 Drawing Sheets

(56) References Cited

U.S. PATENT DOCUMENTS

| | | | | |
|---|---|---|---|---|
| 2009/0015496 | A1* | 1/2009 | Liu | H01Q 9/0457 343/742 |
| 2009/0256777 | A1* | 10/2009 | Nagai | H01Q 9/0407 343/893 |
| 2009/0295645 | A1* | 12/2009 | Campero | H01Q 9/0407 343/700 MS |
| 2010/0026584 | A1* | 2/2010 | Nakabayashi | H01Q 13/206 343/700 MS |
| 2011/0109524 | A1* | 5/2011 | Saily | H01Q 21/08 343/893 |
| 2014/0078005 | A1* | 3/2014 | Park | H01Q 13/206 343/700 MS |
| 2014/0218259 | A1* | 8/2014 | Lee | H01Q 21/065 343/852 |
| 2014/0333502 | A1* | 11/2014 | Uno | H01Q 21/0075 343/844 |
| 2014/0368396 | A1* | 12/2014 | Shinkai | H01Q 1/38 343/817 |
| 2016/0028148 | A1* | 1/2016 | Tan | H01Q 9/0407 343/702 |
| 2016/0285150 | A1* | 9/2016 | Kikin | H01Q 1/2216 |
| 2016/0359238 | A1* | 12/2016 | Okunaga | H01P 5/12 |
| 2018/0198210 | A1* | 7/2018 | Tong | H01Q 1/3233 |
| 2018/0331430 | A1* | 11/2018 | Xiang | H01Q 13/106 |
| 2019/0302225 | A1* | 10/2019 | Kawaguchi | G01S 13/931 |

* cited by examiner

ANTENNA DEVICE

CROSS-REFERENCE TO RELATED APPLICATIONS

This application is based on and claims priority under 35 USC 119 from Japanese Patent Application No. 2018-153139 filed on Aug. 16, 2018.

FIELD OF THE INVENTION

The present invention relates to an antenna device.

BACKGROUND OF THE INVENTION

Recently, various technologies related to planar antennae having antenna elements formed as conductive patterns on substrates have been proposed. For example, a microstrip antenna proposed in Japanese Patent Application Laid-Open No. 2006-173963 has an antenna electrode which has a rectangular plate shape and is divided into a plurality of electrodes having a slender rectangle shape by slits formed along an excitation direction. Of the plurality of electrodes, one is a power supply electrode, and the others are parasitic electrodes. According to this configuration, it is possible to improve the efficiency of the antenna without increasing the size of the antenna electrode.

SUMMARY OF THE INVENTION

In order to improve the directional characteristic of an antenna device, it is required to increase the front gain and reduce the wide-angle gain. For this reason, for example, designs for laying out a plurality of antenna elements in an array to reduce beam width have been widely made. However, in the conventional antenna devices including the technology proposed in Japanese Patent Application Laid-Open No. 2006-173963, many antenna elements are laid out in an array so that wiring lines are lengthened and the number of distribution circuits increases, whereby loss increases.

The present invention was made in view of such situation, and the present invention provides a technology capable of reducing beam width in an antenna device while suppressing loss.

The present invention is directed to a configuration (first configuration) of an antenna device for transmitting and receiving radio waves by an antenna element formed as a conductive pattern on a substrate, wherein: the antenna element includes: a first element part which is electrically connected to a power supply line; and two second element parts which are electrically connected to the first element part via connection lines, the connection lines being different from the power supply line.

Further, the antenna device of the first configuration may have a configuration (second configuration) that the first element part and the second element parts have rectangular shapes in which the lengths in the direction of the electric field of the radio waves are larger than the lengths in the direction perpendicular to the electric field, and the lengths in the direction of the electric field are the same with each other.

Further, the antenna devices of the first and second configurations may have a configuration (third configuration) that the two second element parts are arranged at positions which are on both sides of the first element part in the direction perpendicular to the direction of the electric field of the radio waves and are symmetrical with respect to the first element part, respectively.

Further, the antenna devices of the first to third configurations may have a configuration (fourth configuration) that the first element part has cuts made close to the part connected to the power supply line.

Further, the antenna devices of the first to fourth configurations may have a configuration (fifth configuration) that a plurality of the antenna elements is arranged side by side in the direction perpendicular to the direction of the electric field of the radio waves.

According to the configurations of the present invention, it is possible to reduce the number of antenna element which is required to be laid out in an array in order to obtain a desired beam width, as compared with the conventional art. Accordingly, it is possible to suppress wiring lines from lengthening and suppress the number of distribution circuits from increasing. Therefore, it becomes possible to reduce the beam width in the antenna device while suppressing loss.

DETAILED DESCRIPTION OF THE INVENTION

Hereinafter, illustrative embodiments of the present invention will be described with reference to the drawings. However, the present invention is not limited to the following contents.

1. CONFIGURATION OF ANTENNA DEVICE

Figure 1:
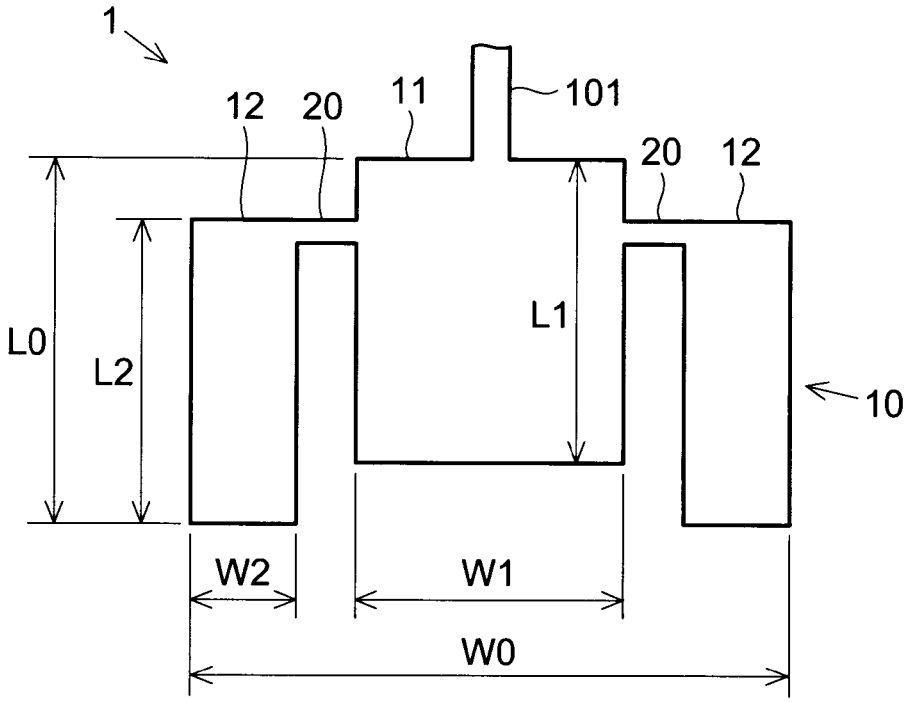
FIG. 1 is a plan view of an example of an antenna device of an embodiment.

FIG. 1 is a plan view illustrating an example of an antenna device 1 of an embodiment. The antenna device 1 of the present embodiment includes an antenna element 10 and connection lines 20. The antenna element 10 and the connection lines 20 are formed as conductive patterns together on a surface of a substrate (not shown in the drawings).

The antenna device 1 transmits and receives radio waves by the antenna element 10 formed as the conductive pattern on the substrate. The substrate is a high-frequency substrate, and is configured to include a dielectric base material layer of a synthetic resin such as a fluorine resin or an epoxy resin and have a plate shape. The antenna element 10 is electrically connected to, for example, the power supply line 101 formed on the surface of the substrate. The antenna element 10 includes one first element part 11 and two second element parts 12.

The first element part 11 is arranged at the center part of the antenna element 10. The first element part 11 is rectangular as seen in a plan view, and is larger than the second element parts 12. The first element part 11 is electrically connected to a power supply line 101.

Of two pairs of opposite sides of the first element part 11, one pair is longer than the other pair. In other words, for example, in FIG. 1, the first element part 11 has a rectangular shape in which the length L1 in the longitudinal direction is larger than the length W1 in the transverse direction. The longitudinal direction of the first element part 11 (the direction of the length L1) coincides with the direction of the electric field of radio waves which can be transmitted and received by the antenna element 10, i.e. the polarization direction.

The two second element parts 12 are arranged at different positions, respectively, so as to be close to the first element part 11 with gaps. The two second element parts 12 have the same shape, i.e. a rectangular shape having the same size as seen in a plan view, and are smaller than the first element part 11. The two second element parts 12 are electrically connected to the first element part 11 via connection lines 20 different from the power supply line 101, respectively.

Of two pairs of opposite sides of the second element part 12, one pair is longer than the other pair. In other words, for example, in FIG. 1, the second element part 12 has a rectangular shape in which the length L2 in the longitudinal direction is larger than the length W2 in the transverse direction. The longitudinal direction of the second element part 12 (the direction of the length L2) coincides with the direction of the electric field of radio waves which can be transmitted and received by the antenna element 10, i.e. the polarization direction.

2. DIRECTIONAL CHARACTERISTIC OF ANTENNA DEVICE

The opening length W0 of the antenna element 10 in the direction (the transverse direction of FIG. 1) perpendicular to the direction of the electric field of radio waves and the opening length L0 of the antenna element in the direction of the electric field of radio waves (the longitudinal direction of FIG. 1) can be arbitrarily determined. The opening length W0 of the antenna element 10 in the transverse direction can be adjusted by extending the connection lines 20. The opening length L0 of the antenna element 10 in the longitudinal direction can be adjusted by changing the positions of the second element parts 12.

Figure 2:
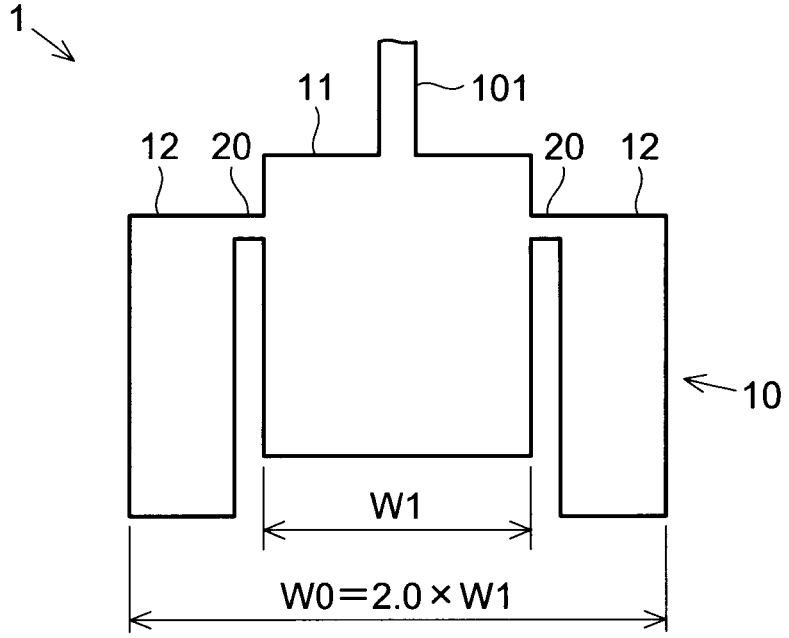
FIG. 2 is a plan view of an antenna device of a first modification.

FIG. 2 is a plan view of an antenna device 1 of a first modification. The opening length W0 of the antenna element 10 of the first modification in the direction (the transverse direction of FIG. 2) perpendicular to the direction of the electric field of radio waves is, for example, 2.0 times the length W1 of the first element part 11 in the transverse direction (W0=2.0×W1).

Figure 3:
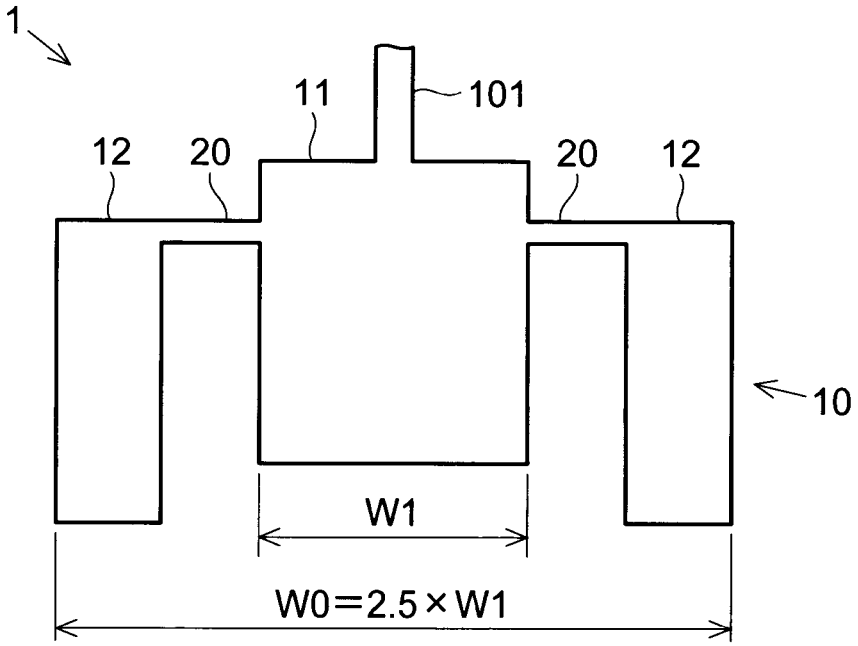
FIG. 3 is a plan view of an antenna device of a second modification.

FIG. 3 is a plan view of an antenna device 1 of a second modification. The opening length W0 of the antenna element 10 of the second modification in the direction (the transverse direction of FIG. 3) perpendicular to the direction of the electric field of radio waves is, for example, 2.5 times the length W1 of the first element part 11 in the transverse direction (W0=2.5×W1).

Figure 4:
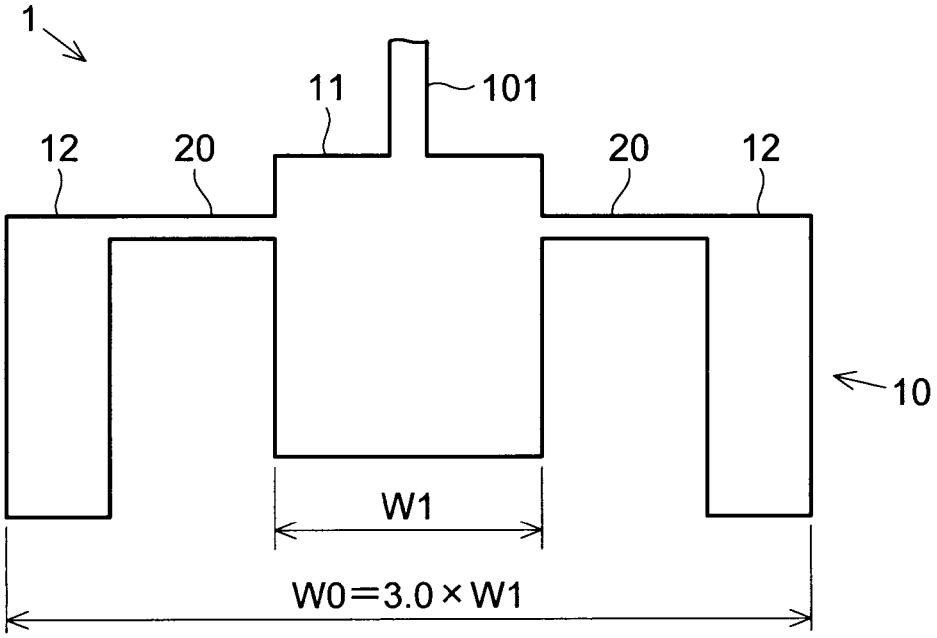
FIG. 4 is a plan view of an antenna device of a third modification.

FIG. 4 is a plan view of an antenna device 1 of a third modification. The opening length W0 of the antenna element 10 of the third modification in the direction (the transverse direction of FIG. 4) perpendicular to the direction of the electric field of radio waves is, for example, 3.0 times the length W1 of the first element part 11 in the transverse direction (W0=3.0×W1).

Figure 5:
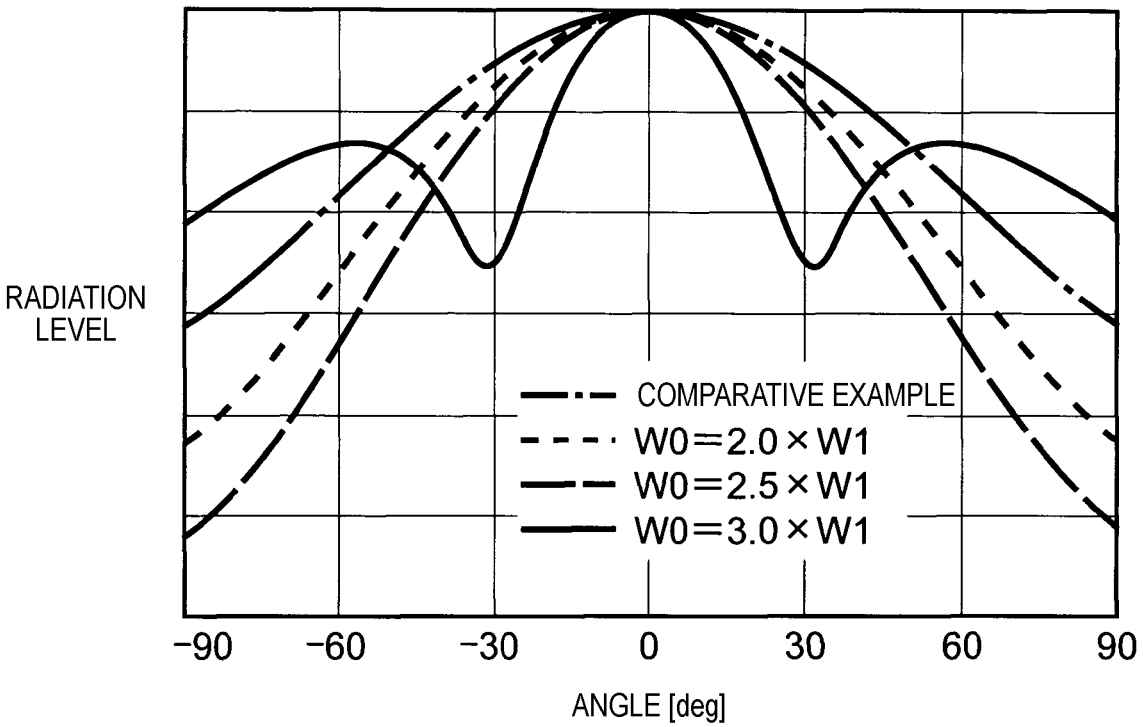
FIG. 5 is a view illustrating the directional characteristic of the antenna device of the embodiment.

FIG. 5 is a view illustrating the directional characteristic of the antenna device 1 of the embodiment. As shown in FIG. 5, it is possible to compare the directional characteristics of radio waves in the cases different in the opening lengths W0 of the antenna elements 10 in the direction perpendicular to the direction of the electric field of radio waves (the transverse directions of FIG. 2, FIG. 3, and FIG. 4). In the graph shown in FIG. 5, the horizontal axis represents the spreading angles of radio waves in the direction perpendicular to the direction of the electric field of radio waves, and the vertical axis represents the radiation levels of the radio waves. However, an antenna device of a comparative example has an antenna element which is only a single rectangular conductive pattern.

According to FIG. 5, in the direction perpendicular to the direction of the electric field of radio waves, the antenna devices 1 shown as the examples in FIG. 2, FIG. 3 and FIG. 4 can reduce beam width (to a beam width of 3 dB) as compared to the antenna device of the comparative example. Further, if the opening lengths W0 of the antenna elements 10 in the direction (the transverse direction) perpendicular to the direction of the electric field of radio waves are further increased, it becomes possible to further reduce the beam width in the transverse direction.

Figure 6:
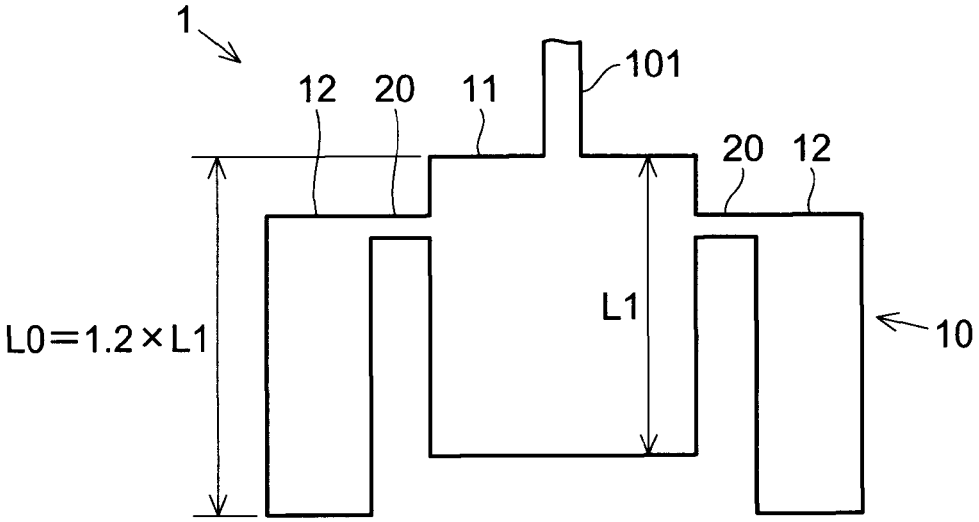
FIG. 6 is a plan view of an antenna device of a fourth modification.

FIG. 6 is a plan view of an antenna device 1 of a fourth modification. The opening length L0 of the antenna element 10 of the fourth modification in the direction of the electric field of radio waves (the longitudinal direction of FIG. 6) is, for example, 1.2 times the length L1 of the first element part 11 in the longitudinal direction (L0=1.2×L1).

Figure 7:
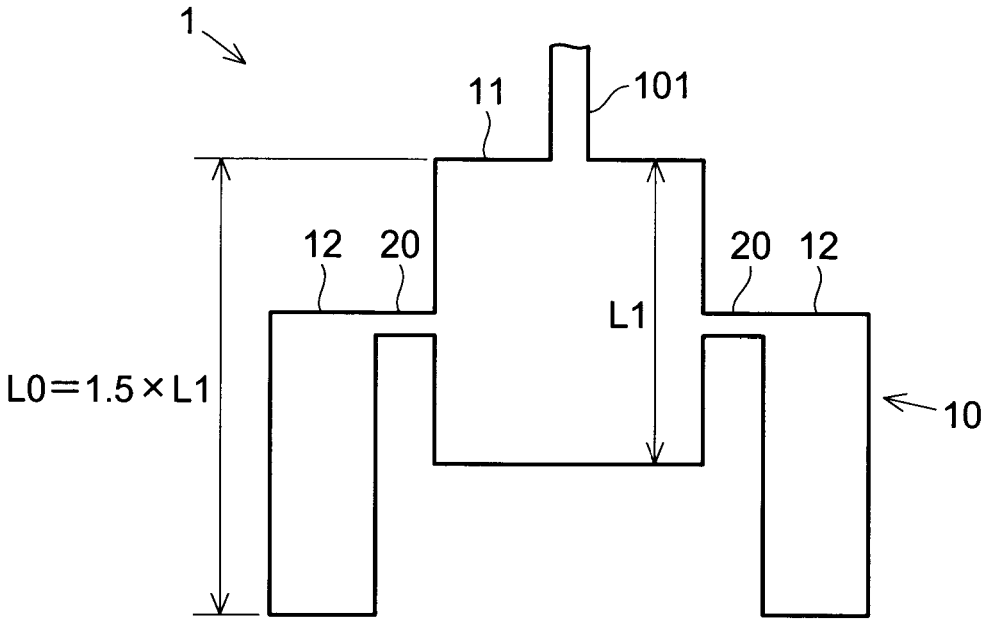
FIG. 7 is a plan view of an antenna device of a fifth modification.

FIG. 7 is a plan view of an antenna device 1 of a fifth modification. The opening length L0 of the antenna element 10 of the fifth modification in the direction of the electric field of radio waves (the longitudinal direction of FIG. 7) is, for example, 1.5 times the length L1 of the first element part 11 in the longitudinal direction (L0=1.5×L1).

Figure 8:
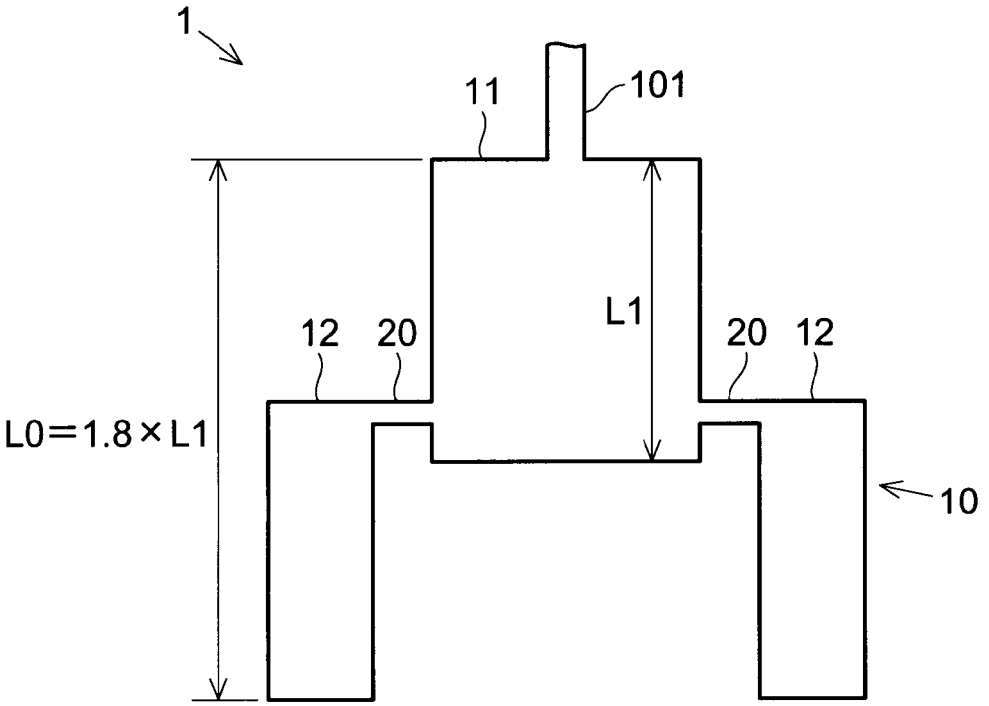
FIG. 8 is a plan view of an antenna device of a sixth modification.

FIG. 8 is a plan view of an antenna device 1 of a sixth modification. The opening length L0 of the antenna element 10 of the sixth modification in the direction of the electric field of radio waves (the longitudinal direction of FIG. 8) is, for example, 1.8 times the length L1 of the first element part 11 in the longitudinal direction (L0=1.8×L1).

Even in the direction of the electric field of radio waves, similarly, the antenna devices 1 shown as the examples in FIG. 6, FIG. 7 and FIG. 8 can reduce beam width (to a beam width of 3 dB) as compared to the antenna device of the comparative example. Further, if the opening length L0 of the antenna element 10 in the electric field direction of radio waves (the longitudinal direction) are further increased, it becomes possible to further reduce the beam width in the longitudinal direction.

As described above, in the antenna device 1 of the present embodiment, the antenna element 10 has a first element part 11 which is electrically connected to a power supply line 101, and two second element parts 12 which are electrically connected to the first element part 11 via connection lines 20 different from the power supply line 101. According to this configuration, the antenna device 1 can reduce the beam width by increasing the opening length L0 of the antenna element 10 in the direction of the electric field of radio waves (the longitudinal direction of FIG. 1) and the opening length W0 of the antenna element in the direction (the transverse direction of FIG. 1) perpendicular to the direction of the electric field. In other words, it is possible to reduce the number of antenna element 10 which are required to be laid out in an array in order to obtain a desired beam width, as compared to the related art. Accordingly, in the antenna device 1, it is possible to suppress wiring lines from lengthening and suppress the number of distribution circuits from increasing, without increasing the number of antenna element 10. Therefore, in the antenna device 1, it becomes possible to reduce the beam width while suppressing loss.

Referring to FIG. 1 again, the length L1 of the first element part 11 in the direction of the electric field of radio waves (the longitudinal direction of FIG. 1) is, for example, the same length as half of the guided wavelength of radio waves being transmitted at the antenna element 10. In this regard, the guided wavelength is a wavelength of the radio waves at the time of propagating in a transmission line such as microstrip. The length L2 of the second element part 12 in the direction of the electric field of radio waves (the longitudinal direction of FIG. 1) is, for example, the same length as half of the guided wavelength of radio waves being transmitted at the antenna element 10. In other words, both of the first element part 11 and the second element part 12 have the rectangular shapes in which the lengths L1 and L2 in the direction of the electric field of radio waves are longer than the lengths W1 and W2 in the direction perpendicular to the electric field, respectively, and the lengths L1 and L2 in the direction of the electric field are the same with each other (L1=L2).

According to this configuration, in the first element part 11 and the second element part 12, it is possible to align the directions of the electric fields which are transmitted and received by the antenna element 10, i.e. the polarization directions. Therefore, in the antenna device 1, it is possible to reduce the beam width while suppressing loss, and it becomes possible to polarize radio waves in a desired direction.

Two second element parts 12 are arranged on both sides of the first element part 11 in the direction (the transverse direction of FIG. 1) perpendicular to the direction of the electric field of radio waves, respectively. More specifically, two second element parts 12 are arranged at positions which are on the both sides of the first element part 11 in the transverse direction and are symmetrical with respect to the first element part 11, respectively. Two second element parts 12 are arranged on both sides of the first element part 11 in the transverse direction with gaps having the same interval, respectively. In other words, the lengths of two connection lines 20 in the extension direction are same.

According to this configuration, it is possible to make the antenna element 10 to have a bilateral symmetry structure in the direction (the transverse direction) perpendicular to the direction of the electric field of radio waves. Therefore, in the antenna device 1, it is possible to reduce the beam width, and it becomes possible to form a beam having bilateral symmetry radiation level.

3. REFLECTION CHARACTERISTIC OF ANTENNA DEVICE

Figure 9:
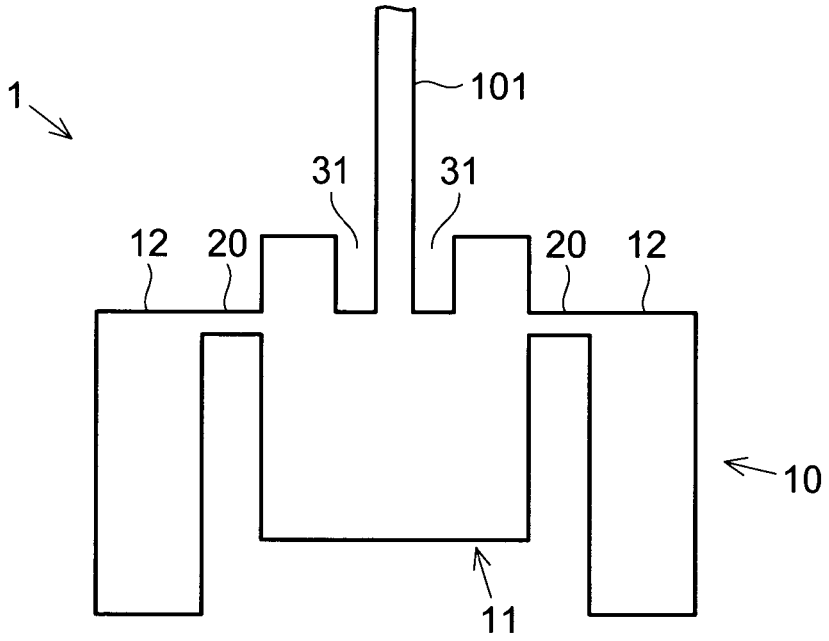
FIG. 9 is a plan view of an antenna device of a seventh modification.

FIG. 9 is a plan view of an antenna device 1 of a seventh modification. In the antenna device 1 of the seventh modification, the first element part 11 of the antenna element 10 has cuts 31. The cuts 31 are arranged close to the part of the first element part 11 connected to a power supply line 101. The cuts 31 are, for example, rectangular as seen in a plan view, and are made from the outer periphery part of the first element part 11 into the first element part 11 along the extension direction of the power supply line 101.

Figure 10:
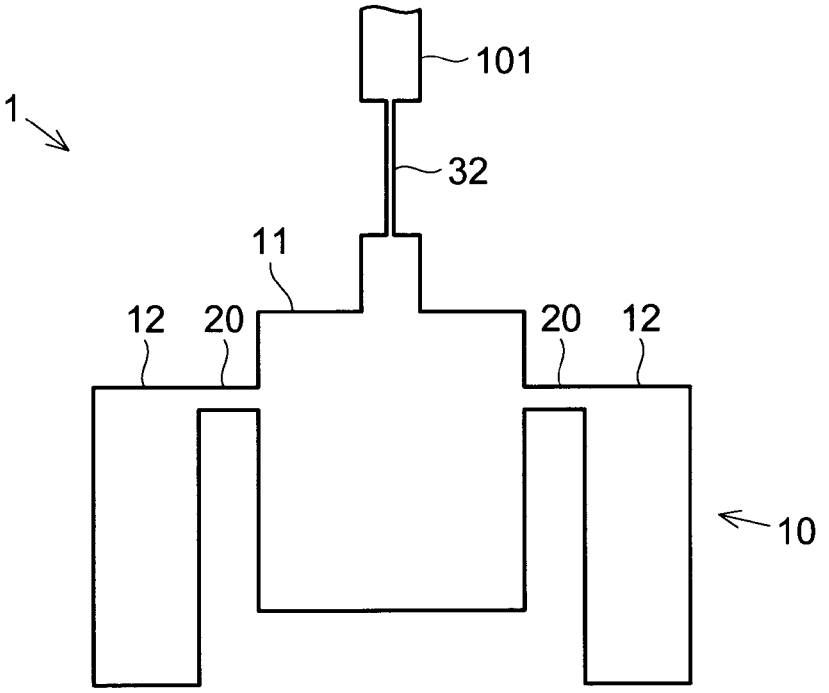
FIG. 10 is a plan view of an antenna device of an eighth modification.

FIG. 10 is a plan view of an antenna device 1 of an eighth modification. In the antenna device 1 of the eighth modification, the power supply line 101 has a stub part 32. At the stub part 32, the power supply line 101 is narrower.

Figure 11:
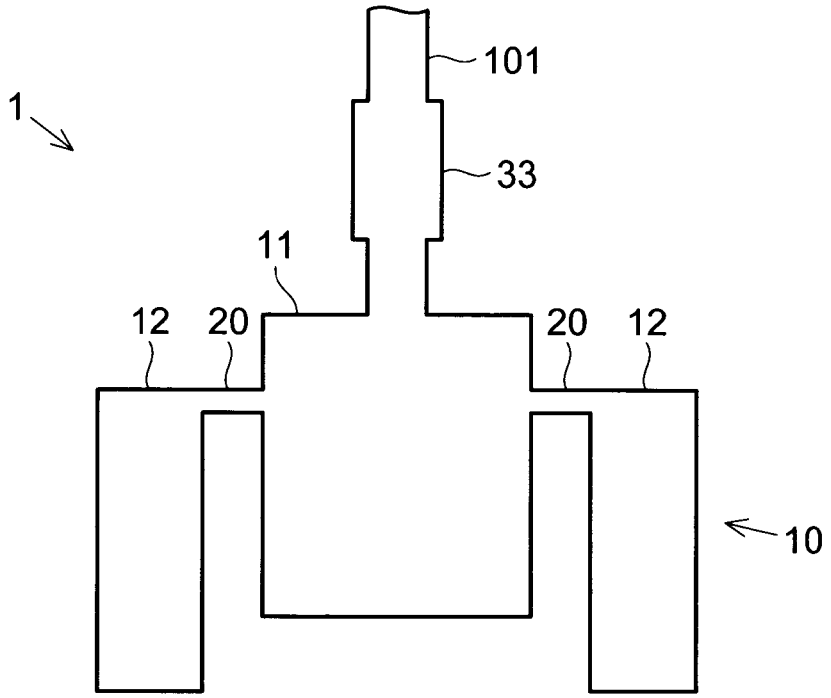
FIG. 11 is a plan view of an antenna device of a ninth modification.

FIG. 11 is a plan view of an antenna device 1 of a ninth modification. In the antenna device 1 of the ninth modification, the power supply line 101 has a stub part 33. At the stub part 33, the power supply line 101 is wider.

Figure 12:
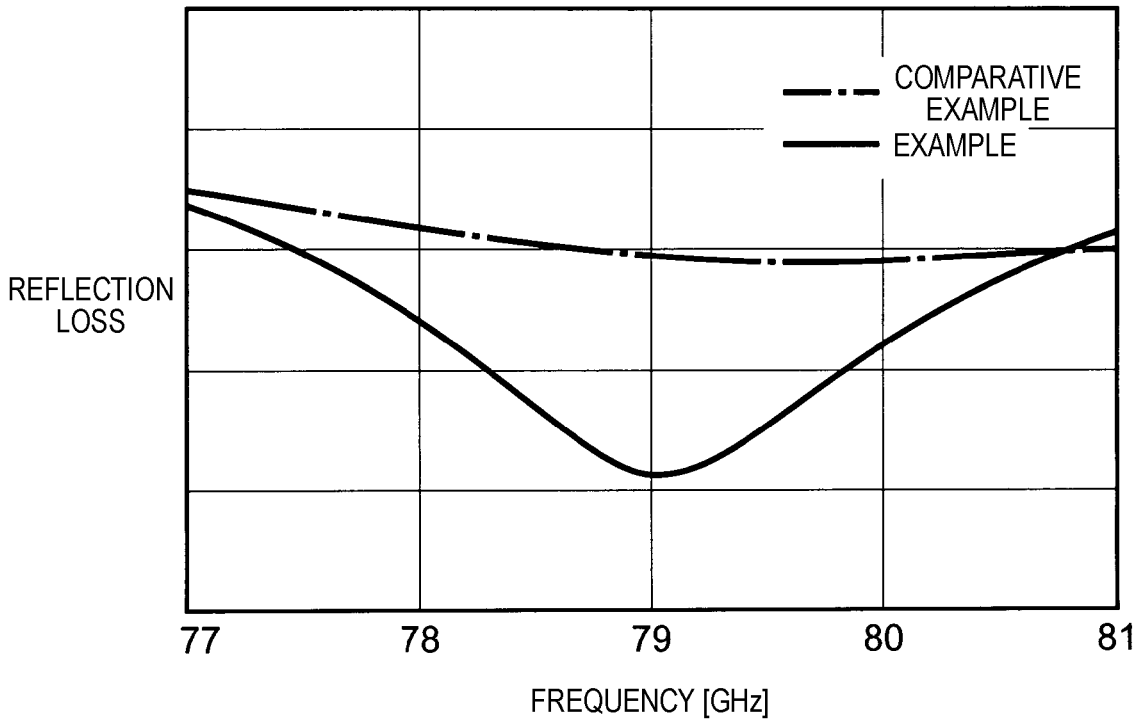
FIG. 12 is a view illustrating the reflection characteristic of the antenna device of the embodiment.

FIG. 12 is a view illustrating the reflection characteristic of the antenna device 1 of the embodiment. In the graph shown in FIG. 12, the horizontal axis represents the frequencies of radio waves which can be transmitted and received by the antenna device 1, and the vertical axis represents the reflection losses of radio waves in the antenna device 1. Also, the example shown in FIG. 12 is the antenna device 1 of the modification shown in FIG. 9, FIG. 10, or FIG. 11, and the comparative example shown in FIG. 12 is an antenna device which does not have any cut and any stub part.

According to FIG. 12, the antenna devices 1 shown as the examples in FIG. 9, FIG. 10, and FIG. 11 can reduce reflection loss around 79 GHz which is a desired frequency as compared to the antenna device of the comparative example. In other words, it becomes possible to realize appropriate impedance matching between the antenna element 10 and the power supply line 101. Therefore, it is possible to efficiently transmit radio waves between the antenna element 10 and the power supply line 101.

4. LAYOUT OF ANTENNA ELEMENTS IN ARRAY

Figure 13:
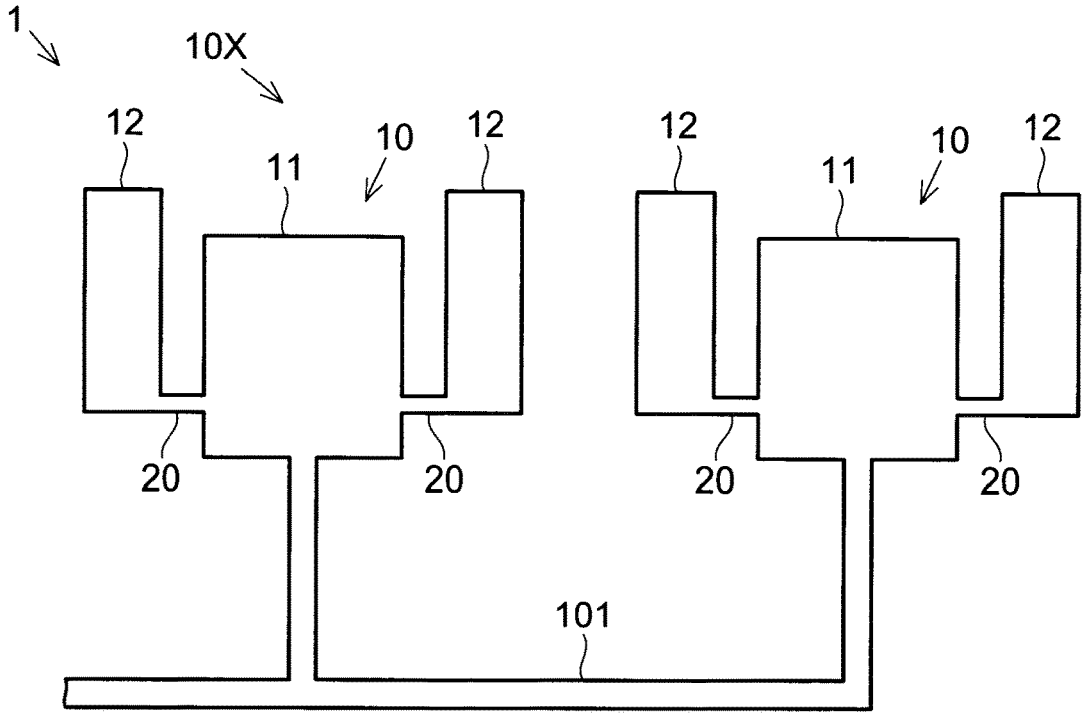
FIG. 13 is a plan view of an antenna device (an array) of a tenth modification.

FIG. 13 is a plan view of an antenna device 1 (an array) of a tenth modification. The antenna device 1 of the tenth modification includes an array 10X of antenna elements 10. In the antenna device 1, a plurality of antenna elements 10 is arranged side by side in the direction perpendicular to the direction of the electric field of radio waves (the transverse direction of FIG. 13). In the antenna device 1, a plurality of antenna elements 10 is arranged in series with power supply lines 101. If a plurality of antenna elements 10 is arranged in series with the power supply lines 101, it is possible to minimize the lengths of wiring lines related to layout of the antenna elements 10 in an array.

Figure 14:
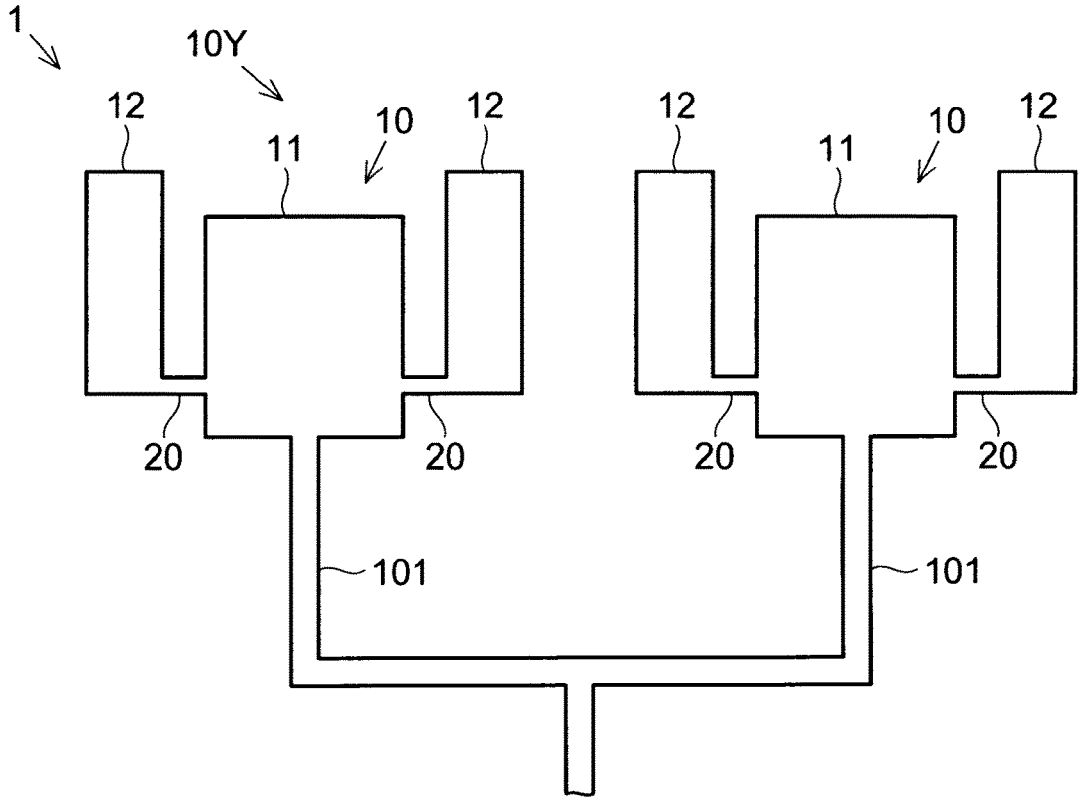
FIG. 14 is a plan view of an antenna device (an array) of an eleventh modification.

FIG. 14 is a plan view of an antenna device 1 (an array) of an eleventh modification. The antenna device 1 of the eleventh modification includes an array 10Y of antenna elements 10. In the antenna device 1, a plurality of antenna elements 10 is arranged side by side in the direction perpendicular to the direction of the electric field of radio waves (the transverse direction of FIG. 14). In the antenna device 1, a plurality of antenna elements 10 is arranged in parallel with power supply lines 101. If a plurality of antenna elements 10 is arranged in parallel with power supply lines 101, the lengths of the power supply lines 101 become the same. Therefore, it becomes possible to stabilize radio waves in the direction (the transverse direction of FIG. 14) perpendicular to the direction of the electric field.

Figure 15:
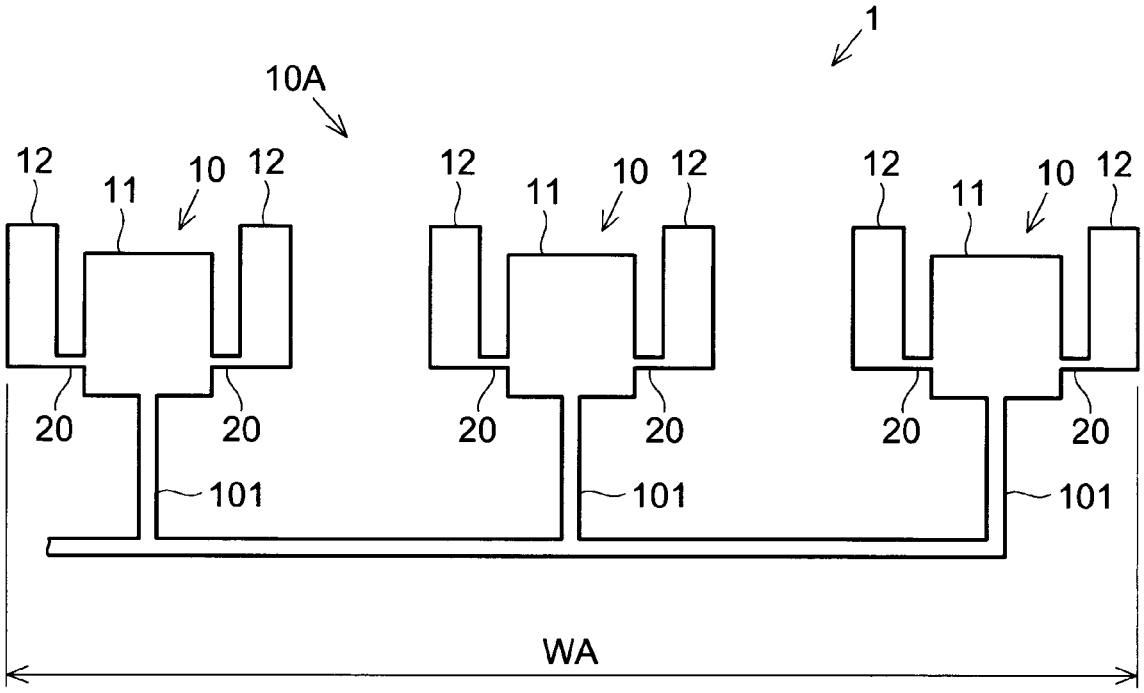
FIG. 15 is a plan view of an antenna device (an array) of a twelfth modification.

FIG. 15 is a plan view of an antenna device 1 (an array) of a twelfth modification. The antenna device 1 of the twelfth modification includes an array 10A of antenna elements 10. In the antenna device 1, for example, three antenna elements 10 are arranged side by side in the direction perpendicular to the direction of the electric field of radio waves (the transverse direction of FIG. 15). In the antenna device 1, three antenna elements 10 are arranged in series with power supply lines 101. In the antenna device 1, the whole of the array 10A has a predetermined opening length WA in the direction (the transverse direction of FIG. 15) perpendicular to the direction of the electric field of radio waves.

Figure 16:
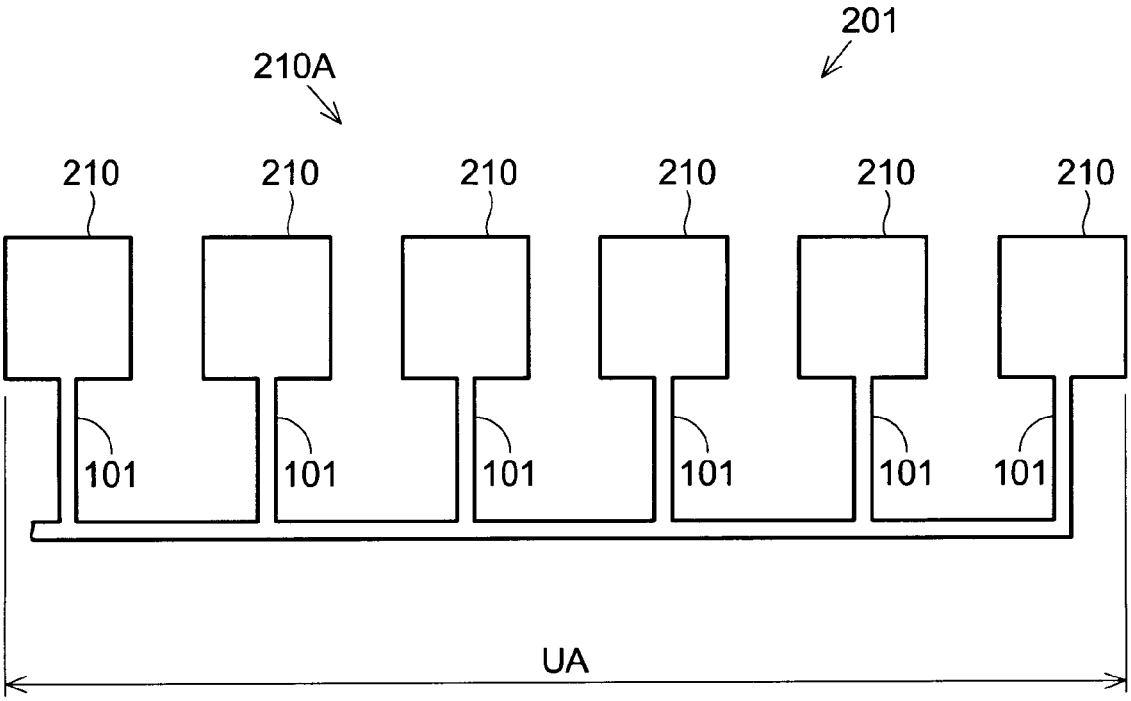
FIG. 16 is a plan view of an antenna device (an array) of a comparative example.

FIG. 16 is a plan view of an antenna device 201 (an array) of a comparative example. FIG. 16 shows the antenna device 201 as a comparative example relative to the antenna device 1 of the twelfth modification (an example) of FIG. 15. The antenna device 201 which is the comparative example includes an array 210A of antenna elements 210. In the antenna device 201 of the comparative example, for example, six antenna elements 210 are arranged side by side in the direction (the transverse direction of FIG. 16) perpendicular to the direction of the electric field of radio waves. In the antenna device 201 of the comparative example, six antenna elements 10 are arranged in series with power supply lines 101. In the antenna device 201 of the comparative example, the whole of the array 210A has a predetermined opening length UA in the direction (the transverse direction of FIG. 16) perpendicular to the direction of the electric field of radio waves.

The opening length WA (see FIG. 15) of the example (the twelfth modification), i.e. the antenna device 1 having the array of the antenna elements 10 is the same as the opening length UA (see FIG. 16) of the comparative example, i.e. the antenna device 201 having the array of the antenna elements 210.

Figure 17:
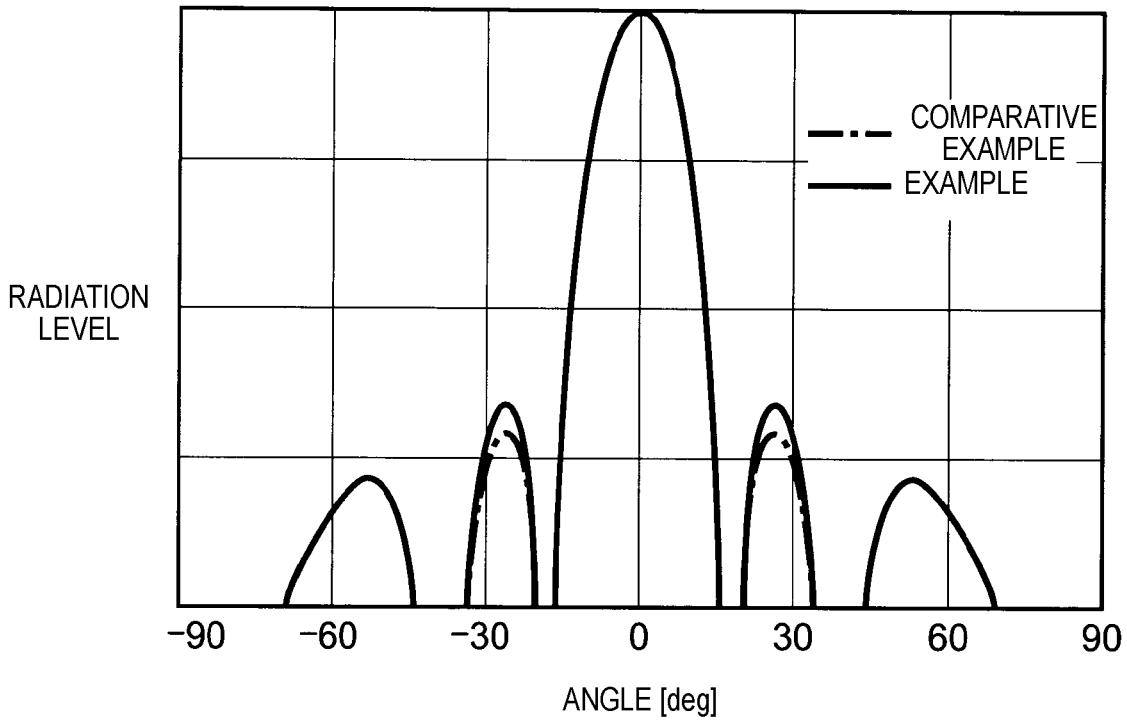
FIG. 17 is a view of the directional characteristic of the antenna device (an array) of the embodiment.

FIG. 17 is a view illustrating the directional characteristic of the antenna device 1 (the array) of the embodiment. In the graph shown in FIG. 17, the horizontal axis represents the spreading angles of radio waves in the direction perpendicular to the direction of the electric field of radio waves, and the vertical axis represents the radiation levels of the radio waves. Also, the example shown in FIG. 17 is the antenna device 1 of the twelfth modification shown in FIG. 15, and the comparative example shown in FIG. 17 is the antenna device 201 shown as the comparative example in FIG. 16. As shown in FIG. 17, if the antenna elements are arranged in an array, it is possible to further reduce the beam width (to a beam width of 3 dB).

Also, it can be seen from FIG. 17 that in the direction perpendicular to the direction of the electric field of radio waves, the radio wave spreading characteristic and the radio wave radiation level of the antenna device 1 shown as the example in FIG. 15 are substantially the same as those of the antenna device 201 shown as the comparative example in FIG. 16. In other words, the antenna device 1 of the example having the three antenna elements 10 can transmit and receive radio waves having substantially the same characteristics as those of radio waves which the comparative example, i.e. the antenna device 201 having the six antenna elements 210 can transmit and receive. In other words, the antenna device 1 which is the example can transmit and receive radio waves having the same characteristics as those of radio waves which the comparative example, i.e. the antenna device 201 having the six antenna elements 210 can transmit and receive, by less antenna elements 10 than those in the antenna device 201 which is the comparative example.

Even in the antenna device 201 of the comparative example, it is possible to realize a smaller beam width by less antenna elements 210 by widening the intervals between neighboring antenna elements 210. However, if the intervals between neighboring antenna elements 210 are wide, grating lobes may occur. In the antenna device 1 of the embodiment, since the opening length of each antenna element 10 is large, it is possible to realize a smaller beam width by less antenna elements, without generating grating lobes.

5. OTHERS

Various technical features disclosed in this specification can be modified variously without departing from the spirit of the technical invention besides the embodiment described above. In other words, it should be understood that the embodiments described above are illustrative and non-restrictive in every respect. It should be understood that the scope of the present invention is defined by the terms of the claims, rather than the description above, and is intended to include any modifications within the scope and meaning equivalent to the terms of the claims. Also, some of the embodiments and the modifications described above may be appropriately combined in an acceptable range.

What is claimed is:

1. An antenna device for transmitting and receiving radio waves by an antenna element formed as a conductive pattern on a substrate, wherein:

the antenna element comprises:

a first element part which is electrically connected to a power supply line; and two second element parts which are electrically connected to the first element part via connection lines, the connection lines being different from the power supply line, wherein an area of the first element part is larger than an area of each of the two second element parts, each of the first element part and the second element parts has a rectangular shape in which a length in a direction of electric field of the radio waves is larger than a length in a direction perpendicular to the electric field, and the lengths of the first element part and the second element parts in the direction of the electric field are same with each other.

2. The antenna device according to claim 1, wherein:

the two second element parts are arranged at positions which are at both sides of the first element part in the direction perpendicular to the direction of the electric field of the radio waves and are symmetrical with respect to the first element part, respectively.

3. The antenna device according to claim 2, wherein:

the first element part has a cut provided adjacent to a part of the first element part connected to the power supply line.

4. The antenna device according to claim 3, wherein:

a plurality of the antenna elements are arranged side by side in the direction perpendicular to the direction of the electric field of the radio waves.

5. The antenna device according to claim 2, wherein:

a plurality of the antenna elements are arranged side by side in the direction perpendicular to the direction of the electric field of the radio waves.

6. The antenna device according to claim 1, wherein:

the first element part has a cut provided adjacent to a part of the first element part connected to the power supply line.

7. The antenna device according to claim 6, wherein:

a plurality of the antenna elements are arranged side by side in the direction perpendicular to the direction of the electric field of the radio waves.

8. The antenna device according to claim 1, wherein:

a plurality of the antenna elements are arranged side by side in the direction perpendicular to the direction of the electric field of the radio waves.

* * * * *